US007001650B2

(12) United States Patent
Sogabe et al.

(10) Patent No.: US 7,001,650 B2
(45) Date of Patent: Feb. 21, 2006

(54) INTERMEDIATE TRANSFER SHEET

(75) Inventors: Jun Sogabe, Osaka (JP); Tomoaki Yamanaka, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 10/854,154

(22) Filed: May 27, 2004

(65) Prior Publication Data

US 2004/0241354 A1 Dec. 2, 2004

(30) Foreign Application Priority Data

May 27, 2003 (JP) ..... 2003-148976

(51) Int. Cl.
*B41M 5/30* (2006.01)

(52) U.S. Cl. ..... 428/32.51; 428/32.12

(58) Field of Classification Search ..... 428/32.39, 428/32.5, 32.51, 32.52, 32.12
See application file for complete search history.

(56) References Cited

U.S. PATENT DOCUMENTS

| | | | | |
|---|---|---|---|---|
| 5,273,855 | A * | 12/1993 | Omote et al. | 430/143 |
| 5,407,893 | A * | 4/1995 | Koshizuka et al. | 503/227 |
| 2002/0072007 | A1 * | 6/2002 | Kuroki et al. | 428/32.51 |

FOREIGN PATENT DOCUMENTS

| | | | |
|---|---|---|---|
| EP | 0314447 | A * | 5/1989 |
| EP | 0980767 | A * | 2/2000 |
| JP | 7237359 | A * | 9/1995 |
| JP | 11-263079 | | 9/1999 |

* cited by examiner

*Primary Examiner*—Pamela R. Schwartz
(74) *Attorney, Agent, or Firm*—Antonelli, Terry, Stout and Kraus, LLP.

(57) ABSTRACT

An intermediate transfer sheet for use in an intermediate transfer type thermal transfer recording method comprising a support, and at least a release layer and a receptive/adhesive layer laminated on the support in this order, the release layer comprising an acrylic resin, a polyester resin and a joint agent.

4 Claims, 1 Drawing Sheet

Intermediate transfer
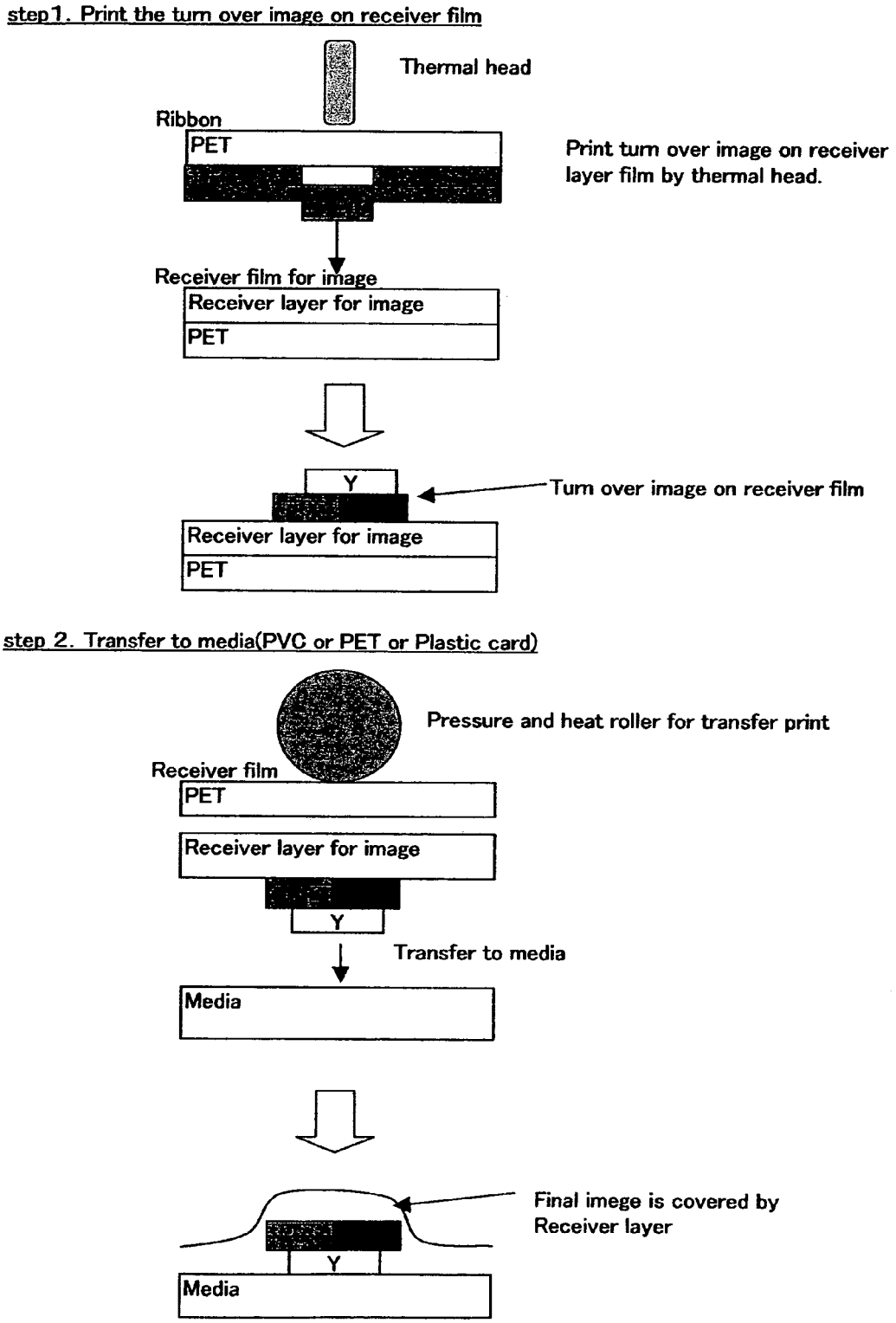

INTERMEDIATE TRANSFER SHEET

BACKGROUND OF THE INVENTION

The present invention relates to an intermediate transfer sheet for use in an intermediate transfer type thermal transfer recording method wherein an ink image is first formed on the intermediate transfer sheet by a melt-type thermal transfer method and the ink image on the intermediate transfer sheet is then transferred onto a final image receptor such as a card or a CD-R by thermal transfer using a hot roller, a hot press, etc. In the present specification, the transfer of the ink image on the intermediate transfer sheet onto the final image receptor is sometimes referred to as "retransfer".

According to the intermediate transfer type thermal transfer recording method, the intermediate transfer sheet is usually composed of a support and a receptive/adhesive layer provided on the support and an ink image is once formed on the receptive/adhesive layer of the intermediate transfer sheet and the ink image on the intermediate transfer sheet is then retransferred onto a final image receptor by thermal transfer using a hot roller, a hot press, etc. Therefore, it is possible to obtain a high-quality image on the final image receptor though depending upon the construction of the receptive/adhesive layer. Also it is possible to improve the adhesion of the ink image onto the final image receptor.

In the prior art, it was frequently carried out to provide a release layer between the support and the receptive/adhesive layer of the intermediate transfer sheet to improve the transferability in the retransferring. The release layer was provided to easily peel the receptive/adhesive layer having the ink image (hereinafter sometimes referred to as "retransfer layer") from the support, thereby improving the transfer efficiency of the retransfer layer onto the final image receptor. The release layer was composed of mainly a resin having an acrylic skeleton. The transfer efficiency is improved as the release layer is easily peeled from the support. Therefore, it is preferable to minimize the adhesion of the release layer against the support. On the other hand, when the adhesion of the release layer against the support is too weak, there occurs a problem that the retransfer layer is accompanied by transfer failure such as tailing or flash. In order to solve the problem, a polyester resin is usually contained in a release layer, imparting such an adhesion to the release layer that the release layer is appropriately held to the support (see patent document 1).

However, the acrylic resin and the polyester resin which are disclosed in patent document 1 are hardly miscible. Therefore, in the case that the acrylic resin is used as a main component for a release layer, the amount of the polyester resin added is much restricted, resulting in failure to obtain the desired results.

Patent Document 1: JP, A, 11-263079

In view of the foregoing, it is an object of the present invention to provide an intermediate transfer sheet which does not cause transfer failure such as tailing or flash with maintaining satisfactory transfer efficiency of the receptive/adhesive layer having an image (retransfer layer).

SUMMARY OF THE INVENTION

As a result of the present inventors' intensive research, it has been discovered that an intermediate transfer sheet for use in an intermediate transfer type thermal transfer recording method comprising a support, and at least a release layer and a receptive/adhesive layer laminated on the support in this order, wherein the release layer comprising an acrylic resin, a polyester resin and a joint agent, accomplished the desired object.

The present invention provides the following intermediate transfer sheets.

(1) An intermediate transfer sheet for use in an intermediate transfer type thermal transfer recording method comprising a support, and at least a release layer and a receptive/adhesive layer laminated on the support in this order, the release layer comprising an acrylic resin, a polyester resin and a joint agent.

(2) The intermediate transfer sheet as referred to in (1) above, wherein the joint agent comprises a ketone-formaldehyde resin.

(3) The intermediate transfer sheet of (1) or (2) above, wherein the polyester resin has a number average molecular weight Mn of 1,000 to 4,000.

DETAILED DESCRIPTION

The intermediate transfer sheet for use in an intermediate transfer type thermal transfer recording method according to the present invention has a fundamental structure wherein at least a release layer and a receptive/adhesive layer are laminated on a support in this order.

As the support used in the present invention, web-like materials as supports for conventional thermal transfer sheets can be used. In terms of durability, heat transmittance and cost, a polyethylene terephthalate (PET) film having a thickness of 9 to 100 $\mu$m is preferably used. Porous sheets having a cushiony property such as foamed PET sheet can also be used.

The release layer, which is a characteristic element of the present invention, does not cause transfer failure such as tailing or flash with maintaining the satisfactory transfer efficiency of the receptive/adhesive layer having an image (retransfer layer), and is composed of an acrylic resin having satisfactory releasing property, a polyester resin imparting adhesion to the support and a joint agent.

The acrylic resin and the polyester resin are hardly miscible with each other. A joint agent is added to both resins so that both resins are easily miscible with each other. A ketone-formaldehyde resin is preferable as the joint agent.

The proportion of these ingredients is as follows: The amounts of the polyester resin and the joint agent are preferably from 10 to 200 parts by weight (more preferably from 10 to 100 parts by weight) and from 10 to 200 parts by weight (more preferably from 10 to 100 parts by weight), respectively, relative to 100 parts by weight of the acrylic resin. When the amount of the polyester resin is less than the above range, the adhesion of the release layer to the support tends to be lowered. When the amount of the polyester resin is more than the above range, the transfer efficiency of the retransfer layer tends to be degraded. When the amount of the joint agent is less than the above range, the miscibility between the acrylic resin and the polyester resin tends to be insufficient. When the amount of the joint agent is more than the above range, the peeling of the retransfer layer tends not to be stabilized.

Examples of the acrylic resin used in the release layer are acrylic acid resin, methacrylic acid resin, alkyl acrylate resins, alkyl methacrylate resins, acrylonitrile resin, and acrylonitrile-styrene resin. The alkyl groups in the alkyl acrylate resins and alkyl methacrylate resins are, for instance, those having 1 to 25 carbon atoms such as methyl, ethyl, propyl, isopropyl, butyl, amyl, octyl and stearyl.

The acrylic resin used in the release layer preferably has a number average molecular weight Mn of 1,000 to 10,000, more preferably 1,000 to 5,000. When the Mn is less than the above range, the adhesion of the release layer against support tends to be lowered, resulting in transfer failure such as tailing or flash. When the Mn is more than the above range, the retransfer property tends to be degraded. Further, the acrylic resin preferably has a glass transition temperature (Tg.) of 30° to 130° C.

The polyester resin which is used to adjust the adhesion of the release layer against the support preferably has a number average molecular weight Mn of 1,000 to 10,000, more preferably 1,000 to 4,000 to achieve a good balance between the adhesion against the support and the transfer efficiency. When the Mn is less than the above range, the adhesion against the support tends to be lowered. When the Mn is larger than the above range, transfer failure such as flash tends to occur.

Especially typical examples of the ketone-formaldehyde resin used in the release layer are acetophenone-formaldehyde resins and the like.

In the present invention, a ketone-formaldehyde resin having a number average molecular weight Mn of 500 to 2,000 is particularly preferably used. When the Mn is less than the above range, the miscibility between the acrylic resin and the polyester resin tends to be insufficient. When the Mn is more than the above range, the retransfer property tends to be degraded. Further, the ketone-formaldehyde resin preferably has a glass transition temperature of 30° to 120° C.

The release layer may be incorporated with various additives such as a fluorocarbon resin powder, silica, a wax, and zinc stearate to improve the releasing property. The thickness of the release layer is preferably 0.05 to 5.0 μm.

The receptive/adhesive layer must have a function of favorably receiving an ink image from a thermal transfer sheet and another function of favorably adhering to a final image receptor when retransferring.

In order to impart these functions to the receptive/adhesive layer, the main resin component is preferably at least one selected from resins such as a styrene resin having a softening temperature of not less than 100° C., an epoxy resin and an acrylic resin. If necessary, a resin having good adhesion property such as polyurethane resin, polyester resin or olefin resin can be added to the receptive/adhesive layer to improve the adhesion against the final image receptor.

Further, the receptive/adhesive layer may be incorporated with various fillers in order to prevent blocking. Examples of the fillers are fluorocarbon resin particles, melamine resin particles, silicone resin particles, talc, kaolin, magnesium carbonate, titanium oxide, silica, and starch. The receptive/adhesive layer preferably has a thickness of 0.1 to 5.0 μm.

Each of the release layer and the receptive/adhesive layer can be formed by preparing a coating liquid wherein the above-mentioned components are dissolved or dispersed in a suitable solvent and applying the coating liquid onto the support (or the release layer) according to a suitable coating method, followed by drying. Each coating liquid can be incorporated with additives such as film-forming aid, coating liquid stabilizer, levelling agent and defoaming agent. If necessary, a protective layer which may be composed of a resin such as an acrylic resin may be provided between the release layer and the receptive/adhesive layer.

In the present invention, the formation of an ink image onto the intermediate transfer sheet can be carried out by means of a thermal transfer printer equipped with a thermal head using a thermal transfer ink sheet. The ink image formed on the intermediate transfer sheet is pressed against the a final image receptor under heating so that the ink image is transferred onto the final image receptor. The retransferring can be carried out by a method selected from various methods such as a method using a thermal transfer printer equipped with a thermal head, a hot roller method and a hot press method.

The present invention will be more fully described by way of the following Examples.

EXAMPLES 1 to 2 AND COMPARATIVE EXAMPLE 1

1. Production of Thermal Transfer Sheet

A yellow ink was prepared by dispersing a yellow pigment into a solution of a vinyl chloride/vinyl acetate copolymer resin in an organic solvent. A magenta ink and a cyan ink were prepared in the same manner as above. The yellow ink was applied onto a front side of a 4.5 μm-thick PET film having a heat-resistant layer on the back side in a thickness of 0.5 μm after being dried by a gravure coating method, giving a melt-type yellow thermal transfer sheet. A melt-type magenta thermal transfer sheet and a melt-type cyan thermal transfer sheet were also produced in the same manner as above.

2. Production of Intermediate Transfer Sheet

Each coating liquid for release layer as shown in Table 1 was applied onto a 25 μm-thick PET as a support to form a release layer having a thickness of 2.0 μm after being dried. The following coating liquid for receptive/adhesive layer was applied onto the release layer to form a receptive/adhesive layer having a thickness of 1.0 μm after being dried. Thus, the intermediate transfer sheets of Examples 1 and 2, and Comparative Example 1 were obtained.

TABLE 1

| Component | Ex. 1 | Ex. 2 | Com. Ex. 1 |
|---|---|---|---|
| Acrylic resin<br>Tg. 120° C., Mn 4,300 | 7 | 7 | 10 |
| Polyester resin<br>Tg. 48° C., Mn 2,700 | 2 | | |
| Polyester resin<br>Tg. 45° C., Mn 8,000 | | 2 | |
| Ketone-formaldehyde resin<br>Tg. 50° C., Mn 650 | 1 | 1 | |
| Toluene/MEK (1/1 by wight) | 40 | 40 | 40 |

MEK: methyl ethyl ketone

| Component | Parts by weight |
|---|---|
| α-Methylstyrene/styrene copolymer resin<br>(softening point 120° C., Mn 775) | 5 |
| Epoxy resin<br>(Tg 72° C., Mn 4,250) | 5 |
| Toluene/MEK (1/1 by weight) | 40 |

3. Evaluation of Characteristic Properties (1) Image Forming Property

A full-color image was formed on an intermediate transfer sheet using the yellow, magenta and cyan transfer sheets under the following conditions and the obtained image was evaluated by the naked eye.

Printer: Test printer, 300 dpi edge head, peel distance: 1.0 cm
Image pattern: Portrait (ISO/DIS 12640 registered image data)
Printing speed: 1 inches/second Criteria
◎: Satisfactory dot shapes are reproduced even in the case of minute dots.
○: Satisfactory dot shapes are reproduced.
Δ: Disorder of dots somewhat occurs.
X: Dropout of dots frequently occurs.

(2) Retransfer Property

The intermediate transfer sheet having an image thereon was superimposed on a card made of a vinyl chloride resin and the intermediate transfer sheet/card was pressed under heating at 170° C. by means of a laminator so that the receptive/adhesive layer having the image was retransferred onto the card.

Criteria
○: Satisfactory retransfer occurs.
Δ: A part with bad retransfer occurs.
X: The retransfer is markedly bad.

(3) Flash

With respect to the edge of the receptive/adhesive layer retransferred, it was observed whether any flash was formed.
○: No flash occurs.
Δ: Flash occurs.
The results obtained above are shown in Table 2.

TABLE 2

| | Ex. 1 | Ex. 2 | Com. Ex. 1 |
|---|---|---|---|
| Image forming property | ◎ | ◎ | ◎ |
| Retransfer property | ○ | Δ | ○ |
| Flash | ○ | ○ | X |

As shown in Table 2, Examples 1 and 2 are within the practical range with respect to all characteristic properties. However, Comparative Example 1 was outside the practical range with respect to "flash".

When an image is formed on an intermediate transfer sheet according to the present invention by using a melt-type thermal transfer sheet, an image with high-definition can be obtained. When the image on the intermediate transfer sheet is retransferred onto a final image receptor, a satisfactory retransferred image can be obtained with retaining the high-definition.

What is claimed is:

1. An intermediate transfer sheet for use in an intermediate transfer type thermal transfer recording method wherein an ink image formed on the transfer sheet is transferred to a final image receptor, the intermediate transfer sheet comprising a support, and at least a release layer and a receptive/adhesive layer laminated on the support in this order, the release layer comprising an acrylic resin, a polyester resin and a joint agent in proportion to provide the release layer with a releasing property which does not cause transfer failure of tailing or flash with maintaining a satisfactory transfer efficiency of the receptive/adhesive layer and an ink image formed thereon from the support to a final image receptor during the transfer recording method, wherein the joint agent comprises a ketone-formaldehyde resin.

2. The intermediate transfer sheet of claim 1, wherein the polyester resin has a number average molecular weight Mn of 1,000 to 4,000.

3. The intermediate transfer sheet of claim 1, wherein in said proportion the amounts of the polyester resin and the joint agent are each from 10 to 200 parts by weight relative to 100 parts by weight of the acrylic resin.

4. The intermediate transfer sheet of claim 1, wherein said receptive/adhesive layer has an adhesive property that the receptive/adhesive layer is adhered to the final image receptor during the transfer recording method.

* * * * *